US005971265A

United States Patent [19]

Collins

[11] Patent Number: 5,971,265

[45] Date of Patent: Oct. 26, 1999

[54] REINFORCED PAPERBOARD BOX FOR STORAGE AND SHIPPING OF ELONGATED ITEMS

[76] Inventor: Daren Collins, 10217 Sage Hill Way, Escondido, Calif. 92026

[21] Appl. No.: 09/140,789

[22] Filed: Aug. 27, 1998

[51] Int. Cl.[6] ..... B65D 25/04

[52] U.S. Cl. ..... 229/120.13; 206/740; 206/765; 206/591; 229/120.18; 229/120.21

[58] Field of Search ..... 229/120.08, 120.13, 229/120.14, 120.18, 120.21; 206/591, 592, 740, 743, 744, 765

[56] References Cited

U.S. PATENT DOCUMENTS

| | | | |
|---|---|---|---|
| 1,055,651 | 3/1913 | Porter | 206/740 |
| 2,308,818 | 1/1943 | Levkoff . | |
| 2,536,990 | 1/1951 | Williamson . | |
| 2,847,152 | 8/1958 | Antwerpen | 206/592 |
| 2,850,224 | 9/1958 | Meinhardt et al. . | |
| 2,854,181 | 9/1958 | Smith | 229/120.18 |
| 3,229,889 | 1/1966 | Vrana | 229/120.14 |
| 3,441,125 | 4/1969 | Small | 206/784 |
| 3,563,449 | 2/1971 | Forbes, Jr. | 229/120.18 |
| 3,735,916 | 5/1973 | Buttery . | |
| 3,869,062 | 3/1975 | Jaeschke et al. | 229/120.18 |
| 4,034,908 | 7/1977 | Forbes, Jr. et al. | 229/120.18 |
| 4,177,918 | 12/1979 | Lane . | |
| 4,342,417 | 8/1982 | Forbes, Jr. . | |
| 5,495,983 | 3/1996 | Lelek . | |
| 5,775,573 | 7/1998 | Smith | 229/120.14 |

*Primary Examiner*—Gary E. Elkins

*Attorney, Agent, or Firm*—Beehler & Pavitt; William H. Pavit, Jr.; David A. Belasco

[57] ABSTRACT

A reinforced paperboard box for storage and shipping of elongated items is described. The box is formed from a single piece of paperboard and may be rapidly assembled without the use of tools. The box comprises an elongated rectangular bottom panel, first and second joined side panels, a top panel, a front reinforcing panel and dividing partition all foldably joined at elongated edges and constructed to form a multi-level elongated box. The first side panel has a pair of abutting end panels foldably joined to either end, with a tab receiving panel and a locking panel foldably joined to either side of the end panel. The second side panel has a pair of end panels foldably joined to either end, that are locked in place by the locking panels and tab receiving panels of the first side panel. The dividing partition is includes at least one pair of cuts and a series of perforations enabling the dividing partition to be folded inwardly so as to divide the interior space of the box into at least two compartments. Variations of the invention include additional perforations along the dividing partition and locking panels to aid in assembly of the box. Other variations include angled cuts to the dividing partition for special shaped compartments and use of multiple cuts and related perforations in the dividing partition to form a plurality of compartments within the box.

20 Claims, 5 Drawing Sheets

REINFORCED PAPERBOARD BOX FOR STORAGE AND SHIPPING OF ELONGATED ITEMS

FIELD OF INVENTION

The invention pertains to a paperboard box construction. More particularly, the invention relates to a box construction adapted for storage and shipping of items that must be protected from crushing, folding or bending forces.

BACKGROUND OF THE INVENTION

Various types of paperboard boxes, tubes and containers have been devised to protect elongated articles during shipment.

U.S. Pat. No. 2,604,255, issued to Welshenbach, describes a container having a knock-down body made from a one-piece blank of material such as paperboard. The container has end walls stiffened by flaps projecting into the container and serving as partitions to separate the contents of the container. U.S. Pat. No. 1,623,547, issued to Neumann, discloses an elongated, trapezoidal box for shipping and display of golf clubs, formed from a single blank of paperboard material. U.S. Pat. No. 2,253,008, issued to Anderson, describes a display box for golf clubs that may also be used for shipping. The box includes slotted divider panels to prevent the clubs from contacting one another during shipping. Another U.S. Pat. No. 4,236,740, issued to Anderson, illustrates another golf club box having a slotted cross bar construction disposed between the spaced apart sides of the box designed to receive the shanks of golf clubs and keep them from damaging each other in shipping. A separate cover is provided for the box.

An effective design for a shipping container for such items must necessarily be a compromise of various factors. It is an objective of the present invention that the container provide the required degree of protection from the forces encountered in transferring the container from one destination to another by means of automated package handling systems, trucks, automobiles and aircraft. In particular, the container should provide protection from bending moments applied to the length of the container. It is another objective of the invention that dividers be provided to segregate the contents of the container to prevent damage to individual items stored within the container. It is a further objective that the container be light in weight to prevent excessive shipping costs. It is yet a further objective of the invention that the container is economical to produce and simple to assemble. It is a still further objective that the container provide a simple and effective means of being sealed and later opened.

While features disclosed in the prior art satisfy some of the objectives of the present invention, none of the inventions found include all of the requirements identified.

SUMMARY OF THE INVENTION

The present invention addresses all of the deficiencies of prior art reinforced paperboard boxes and satisfies all of the objectives described above. A reinforced paperboard box for storage and shipping of elongated items may be formed from a single blank of paperboard material comprising the following components. A rectangular bottom panel is provided having first and second opposed, elongated, parallel, side edges. The bottom panel has third and fourth opposed, parallel end edges normal to the first and second edges, a first predetermined width measured between the first and second edges and a first predetermined length measured between the third and fourth edges.

A first side panel is provided having first and second opposed, elongated, parallel edges of the first predetermined length, third and fourth opposed, parallel end edges, a first predetermined height measured between the first and second edges. The first side panel is foldably joined at its second edge to the first edge of the bottom panel.

First and second abutting rectangular first side end panels are provided, each of the first side end panels having first and second opposed, parallel edges of the first predetermined width. The first side end panels have third and fourth opposed, parallel edges of the first predetermined height. The first first side end panel is foldably joined at its fourth edge to the third edge of the first side panel and the second first side end panel foldably joined at its third edge to the fourth edge of the first side panel.

First and second tab receiving panels are provided, each of the tab receiving panels having a proximate edge not greater in length than the first predetermined width and being foldably joined at the proximate edge to the second edge of one of the first and second first side end panels. Each of the first and second tab receiving panels including a tab opening located along its proximate edge.

First and second locking panels are provided, each of the locking panels having a proximate edge not greater in length than the first predetermined width, and an opposed parallel, distal edge. The locking panels are foldably joined at the proximate edge to the first edge of one of the first and second first side end panels. Each of the first and second locking panels includes a tab member extending outwardly from its distal edge, the tab member sized, shaped and located to engage the tab opening in one of the first and second tab receiving panels.

A second side panel is provided having first and second opposed, elongated, parallel edges of the first predetermined length, third and fourth opposed, parallel end edges, of the first predetermined height measured between the first and second edges. The second panel is foldably joined at its first edge to the second edge of the bottom panel.

First and second abutting rectangular second side end panels are provided. Each of the second side end panels has first and second opposed, parallel edges of the first predetermined width and third and fourth opposed, parallel edges of the first predetermined height. The first second side end panel is foldably joined at its fourth edge to the third edge of the second side panel and the second second side end panel is foldably joined at its third edge to the fourth edge of the second side panel.

A top panel is provided having first and second opposed, elongated, parallel edges of less than the first predetermined length, third and fourth opposed, parallel end edges spaced apart by the first predetermined width. The top panel is foldably joined at its second edge to the first edge of the first side panel.

First and second top end extensions are provided. Each of the top end extensions has a proximate edge not greater in length than the first predetermined width. The top extensions are foldably joined at the proximate edge to one of the third and fourth edges of the second side panel.

A front reinforcing panel is provided having first and second opposed, elongated, parallel edges of the first predetermined length, third and fourth opposed, parallel end edges spaced apart by no more than the first predetermined height. The front reinforcing panel is foldably joined at its second edge to the first edge of the top panel.

First and second front panel end extensions are provided. Each of the end extensions having a proximate edge not greater in length than the first predetermined height. The front panel end extensions are foldably joined at the proximate edge to one of the third and fourth edges of the front reinforcing panel.

A dividing partition is provided having first and second opposed, elongated, parallel edges of a second predetermined length, less than the first predetermined length. The dividing partition has third and fourth opposed, parallel end edges spaced apart a second predetermined width equal to the sum of the first predetermined width and the first predetermined height. The dividing partition is foldably joined at its first edge to the second edge of the second side panel.

The dividing partition includes at least one pair of cuts, each of the first and second cuts spaced from one of the third and fourth edges of the dividing partition. Each of the first and second cuts extends from the first edge of the dividing partition to a first point. The first point is spaced from the first edge by a first predetermined distance. The cut extends from the first point to a second point spaced from the first edge by the first predetermined width, and from the second point to a third point. The third point is spaced from the second edge of the dividing partition by a second predetermined distance.

A first perforation parallel to the first edge of the dividing partition is provided. The first perforation extends from the first point of the first cut to the third edge of the dividing partition. A second perforation parallel to the first edge of the dividing partition is provided. The second perforation extends from the third point of the first cut to the third edge of the dividing partition. A third perforation parallel to the first edge of the dividing partition is provided. The third perforation extends from the second point of the first cut to the second point of the second cut.

A fourth perforation parallel to the first edge of the dividing partition is provided. The fourth perforation extends from the first point of the second cut to the fourth edge of the dividing partition. A fifth perforation parallel to the first edge of the dividing partition is provided. The fifth perforation extends from the third point of the second cut to the fourth edge of the dividing partition.

To assemble the reinforced paperboard box for storage and shipping of elongated items the first and second tab receiving panels are folded inwardly from the first and second first side end panels. The first and second first side end panels are next folded inwardly from the first side panel, and the first side panel is folded inwardly from the bottom panel. The first and second second side end panels are then folded inwardly from the second side panel, and the second side panel is folded inwardly from the bottom panel.

Next, the first and second locking panels are folded over the first and second second side end panels so that the tab members of the first and second locking panels engage the tab openings of the first and second tab receiving panels. The dividing partition is then folded inwardly along the first, second, third, fourth and fifth perforations and inwardly from the second side panel so that its second edge rests upon the bottom panel. Thus, an open topped container divided into a plurality of compartments may be formed.

A closed reinforced paperboard box for storage and shipping of elongated items may be formed by folding the first and second top end extensions inwardly from the top panel and folding the top panel inwardly from the first side panel. In this way the first and second top end extensions bear against the first and second locking panels, and the first and second front panel extensions may be folded inwardly from the front reinforcing panel. Next, the front reinforcing panel is folded inwardly from the top panel and over the second side panel, and the first front panel extension is inserted between the first first side end panels and the first second side end panel and the second front panel extension is inserted between the second first side end panels and the second second side end panel.

A variation of the invention providing additional divisions of the elongated container may be formed as follows. At least one additional pair of cuts (third and fourth cuts) located between one of the first and second cuts, and one of the third and fourth edges of the dividing partition. The third and fourth cuts extend from a fourth point spaced from the first edge of the dividing partition by a third predetermined distance that is less than the first predetermined distance, to a fifth point spaced from the fourth point by the third predetermined distance. The third and fourth cuts then extend from the fifth point to a sixth point. The sixth point is spaced from the fourth point by the first predetermined width. The third and fourth cuts then extend from the sixth point to a seventh point spaced from the sixth point by the third predetermined distance.

In this variation the first point is spaced from the first edge of the dividing partition by the third predetermined distance and the third point is spaced from the second point by the third predetermined distance. Also in this variation, the first perforation extends from the first point on the first cut to the fourth point on the third cut, the second perforation extends from the third point on the first cut to the sixth point on the third cut, the fourth perforation extends from the first point on the second cut to the fourth point on the fourth cut and the fifth perforation extends from the third point on the second cut to the sixth point on the fourth cut.

A sixth perforation parallel to the first edge of the dividing partition is provided that extends from the fifth point of the third cut to the third edge of the dividing partition. A seventh perforation parallel to the first edge of the dividing partition is provided that extends from the seventh point of the third cut to the third edge of the dividing partition. An eighth perforation parallel to the first edge of the dividing partition is provided that extends from the fifth point of the third cut to the fourth edge of the dividing partition. A ninth perforation parallel to the first edge of the dividing partition is provided that extends from the seventh point of the fourth cut to the fourth edge of the dividing partition.

When the dividing partition is folded inwardly along the first through ninth perforations and folded inwardly so that its second edge rests on the bottom panel, a container divided into at least three compartments may be formed.

In another variation of the invention a tenth perforation parallel to the first and an eleventh perforation parallel to the fourth perforation are provided. The tenth and eleventh perforations are spaced a fourth predetermined distance from the first edge of the dividing partition.

When the dividing partition is folded inwardly along the first, second, third, fourth, fifth, tenth and eleventh perforations, the portions of the dividing partition between the first and tenth perforations and between the fourth and eleventh perforations will abut more closely to the second side panel.

In yet another variation of the instant invention, the dividing partition is foldably joined at its first edge to the second edge of the second side panel at a twelfth perforation.

In still another variation of the invention, the first locking panel is foldably joined at its proximate edge to the first edge of the first first side end panel at a thirteenth perforation.

Likewise, the second locking panel is foldably joined at its proximate edge to the first edge of the second first side end panel at an fourteenth perforation.

In yet a further variation of the instant invention a fifteenth perforation parallel to the thirteenth perforation is spaced a fifth predetermined distance from the proximate edge of the first locking panel. Likewise, a sixteenth perforation parallel to the fourteenth perforation is spaced the fifth predetermined distance from the proximate edge of the second locking panel.

When the first and second locking panels are folded over the first and second second side end panels the tab members may more easily engage the tab openings in the first and second tab receiving panels.

In still a further variation of the invention the distal edges of the first and second extensions of the top panel end extensions are rounded for easy insertion between the first and second side panels.

In yet another variation of the instant invention the distal edge of the first front panel end extension is rounded for easy insertion between the first first side end panel and the first second side end panel. Likewise, the distal edge of the second front panel end extension is rounded for easy insertion between the second first side end panel and the second second side end panel.

In a final variation of the invention includes two additional perforations. A seventeenth perforation extends from the first perforation to the second perforation. The seventeenth perforation is spaced from the third edge of the dividing partition. An eighteenth perforation extends from the fourth perforation to the fifth perforation. The eighteenth perforation is spaced from the fourth edge of the dividing partition.

When a user desires to insert an item in a lower compartment of the box having a height at one end greater than the second predetermined distance, the first and second perforations may be severed from the third edge of the dividing partition to the seventeenth perforation. The portion of the dividing partition between the first and second perforations may be folded upwardly along the seventeenth perforation thereby providing additional space above the lower compartment adjacent the third edge of the dividing partition.

Likewise, the fourth and fifth perforations may be severed from the fourth edge of the dividing partition to the eighteenth perforation. The portion of the dividing partition between the fourth and fifth perforation may be folded upwardly along the eighteenth perforation thereby providing additional space above the lower compartment adjacent the fourth edge of the dividing partition.

DESCRIPTION OF THE DRAWINGS

FIG. 6 also illustrates a portion of the dividing partition folded upwardly along the seventh perforation;

DESCRIPTION OF THE PREFERRED EMBODIMENT

Figure 1:
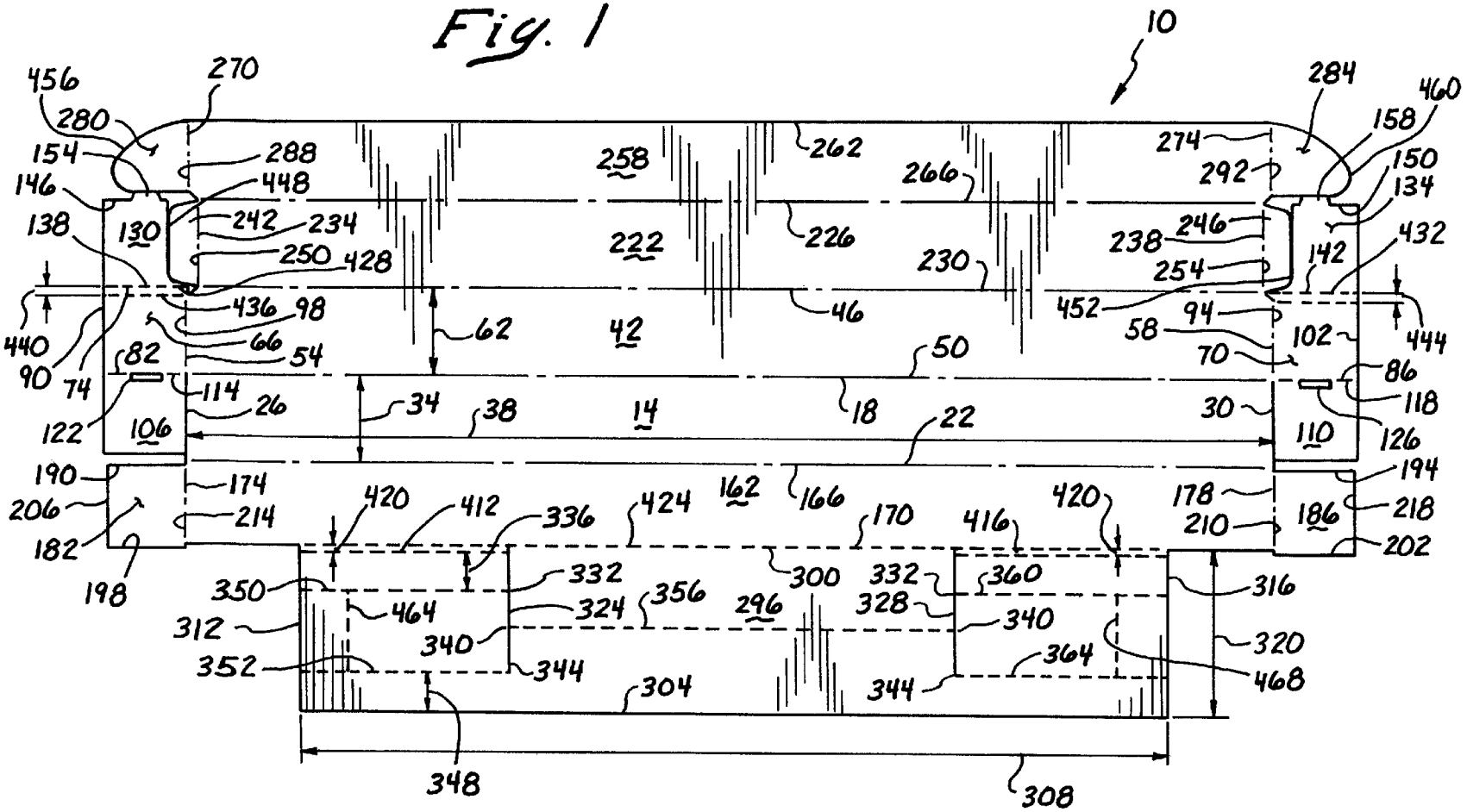
FIG. 1 is a plan view of the preferred embodiment of the invention.

FIG. 1 illustrates a die-cut blank for a reinforced paperboard box 10 for storage and shipping of elongated items. As shown in FIGS. 1–8, the invention comprises the following components. A rectangular bottom panel 14 is provided having first 18 and second 22 opposed, elongated, parallel, side edges. The bottom panel 14 has third 26 and fourth 30 opposed, parallel end edges normal to the first 18 and second 22 edges, a first predetermined width 34 measured between the first 18 and second 22 edges and a first predetermined length 38 measured between the third 26 and fourth 30 edges.

A first side panel 42 is provided having first 46 and second 50 opposed, elongated, parallel edges of the first predetermined length 38, third 54 and fourth 58 opposed, parallel end edges, a first predetermined height 62 measured between the first 46 and second 50 edges. The first side panel 42 is foldably joined at its second edge 50 to the first edge 18 of the bottom panel 14.

First 66 and second 70 abutting rectangular first side end panels are provided, each of the first side end panels 66, 70 having first 74, 78 and second 82, 86 opposed, parallel edges of the first predetermined width 34. The first side end panels 66, 70 have third 90, 94 and fourth 98, 102 opposed, parallel edges of the first predetermined height 62. The first 66 first side end panel is foldably joined at its fourth edge 98 to the third edge 54 of the first side panel 42 and the second 70 first side end panel foldably joined at its third edge 94 to the fourth edge 58 of the first side panel 42.

First 106 and second 110 tab receiving panels are provided, each of the tab receiving panels 106, 110 having a proximate edge 114, 118 not greater in length than the first predetermined width 34 and being foldably joined at the proximate edge 114, 118 to the second edge 82, 86 of one of the first 66 and second 70 first side end panels. Each of the first 106 and second 110 tab receiving panels including a tab opening 122, 126 located along its proximate edge 114, 118.

First 130 and second 134 locking panels are provided, each of the locking panels 130, 134 having a proximate edge 138, 142 not greater in length than the first predetermined width 34, and an opposed parallel, distal edge 146, 150. The locking panels 130, 134 are foldably joined at the proximate edge 138, 142 to the first edge 74, 78 of one of the first 66 and second 70 first side end panels. Each of the first 130 and second 134 locking panels includes a tab member 154, 158 extending outwardly from its distal edge 146, 150, the tab member 154, 158 sized, shaped and located to engage the tab opening 122, 126 in one of the first 106 and second 110 tab receiving panels.

A second side panel 162 is provided having first 166 and second 170 opposed, elongated, parallel edges of the first predetermined length 38, third 174 and fourth 178 opposed, parallel end edges, of the first predetermined height measured between the first 166 and second 170 edges. The second panel 162 is foldably joined at its first 166 edge to the second 22 edge of the bottom panel 14.

First 182 and second 186 abutting rectangular second side end panels are provided. Each of the second side end panels 182, 186 has first 190, 194 and second 198, 202 opposed, parallel edges of the first predetermined width 34 and third 206, 210 and fourth 214, 218 opposed, parallel edges of the first predetermined height 38. The first 182 second side end panel is foldably joined at its fourth 214 edge to the third 174 edge of the second side panel 162 and the second 186 second side end panel is foldably joined at its third edge 210 to the fourth 178 edge of the second side panel 162.

A top panel 222 is provided having first 226 and second 230 opposed, elongated, parallel edges of less than the first predetermined length 38, third 234 and fourth 238 opposed, parallel end edges of the first predetermined width 34. The top panel 222 is foldably joined at its second 230 edge to the first 46 edge of the first side panel 42.

First 242 and second 246 top end extensions are provided. Each of the top end extensions 242, 246 has a proximate edge 250, 254 not greater in length than the first predetermined width 34. The top extensions 242, 246 are foldably joined at the proximate edge 250, 254 to one of the third 234 and fourth 238 edges of the second side panel 222.

A front reinforcing panel 258 is provided having first 262 and second 266 opposed, elongated, parallel edges of the first predetermined length 38, third 270 and fourth 274 opposed, parallel end edges of no more than the first predetermined height 62. The front reinforcing panel 258 is foldably joined at its second 266 edge to the first 226 edge of the top panel 222.

First 280 and second 284 front panel end extensions are provided. Each of the end extensions 280, 284 has a proximate edge 288, 292 not greater in length than the first predetermined height 62. The front panel end extensions 280, 284 are foldably joined at the proximate edge 288, 292 to one of the third 270 and fourth 274 edges of the front reinforcing panel 258.

A dividing partition 296 is provided having first 300 and second 304 opposed, elongated, parallel edges of a second predetermined length 308, less than the first predetermined length 38. The dividing partition 296 has third 312 and fourth 316 opposed, parallel end edges of a second predetermined width 320 equal to the sum of the first predetermined width 34 and the first predetermined height 38. The dividing partition 296 is foldably joined at its first 300 edge to the second 170 edge of the second side panel 162.

The dividing partition 296 includes at least one pair of cuts 324, 328, each of the first 324 and second 328 cuts spaced from one of the third 312 and fourth 316 edges of the dividing partition 296. Each of the first 324 and second 328 cuts extends from the first 300 edge of the dividing partition 296 to a first point 332. The first point 332 is spaced from the first 300 edge by a first predetermined distance 336. The cut 324, 328 extends from the first point 332 to a second point 340 spaced from the first edge 300 by the first predetermined width 34, and from the second point 340 to a third point 344. The third point 344 is spaced from the second edge 304 of the dividing partition 296 by a second predetermined distance 348.

A first perforation 350 parallel to the first 300 edge of the dividing partition 296 is provided. The first perforation 348 extends from the first point 332 of the first cut 324 to the third 312 edge of the dividing partition 296. A second perforation 352 parallel to the first 300 edge of the dividing partition 296 is provided. The second perforation 352 extends from the third point 344 of the first cut 324 to the third edge 312 of the dividing partition 296. A third perforation 356 parallel to the first 300 edge of the dividing partition 296 is provided. The third perforation 356 extends from the second point 340 of the first cut 324 to the second point 340 of the second cut 328.

A fourth perforation 360 parallel to the first 300 edge of the dividing partition 296 is provided. The fourth perforation 360 extends from the first point 332 of the second cut 328 to the fourth 316 edge of the dividing partition 296. A fifth perforation 364 parallel to the first 300 edge of the dividing partition 296 is provided. The fifth perforation 364 extends from the third point 344 of the second cut 328 to the fourth 316 edge of the dividing partition 296.

To assemble the reinforced paperboard box for storage and shipping of elongated items 10 the first 106 and second 110 tab receiving panels are folded inwardly from the first 66 and second 70 first side end panels. The first 66 and second 70 first side end panels are next folded inwardly from the first side panel 42, and the first side panel 42 is folded inwardly from the bottom panel 14. The first 182 and second 186 second side end panels are then folded inwardly from the second side panel 162, and the second side panel 162 is folded inwardly from the bottom panel 14.

Next, the first 130 and second 134 locking panels are folded over the first 182 and second 186 second side end panels so that the tab members 154, 158 of the first 130 and second 134 locking panels engage the tab openings 122, 126 of the first 106 and second 110 tab receiving panels. The dividing partition 296 is then folded inwardly along the first 348, second 352, third 356, fourth 360 and fifth 364 perforations and inwardly from the second side panel 162 so that its second 304 edge rests upon the bottom panel 14. Thus, an open topped container divided into a plurality of compartments may be formed.

A closed reinforced paperboard box for storage and shipping of elongated items 10 may be formed by folding the first 242 and second 246 top end extensions inwardly from the top panel 222 and folding the top panel 222 inwardly from the first side panel 42. In this way the first 242 and second 246 top end extensions bear against the first 130 and second 134 locking panels, and the first 280 and second 284 front panel extensions may be folded inwardly from the front reinforcing panel 258. Next, the front reinforcing panel 258 is folded inwardly from the top panel 222 and over the second side panel 162, and the first 280 front panel extension is inserted between the first 66 first side end panels and the first 182 second side end panel and the second 284 front panel extension is inserted between the second 70 first side end panels and the second 186 second side end panel.

Figure 9:
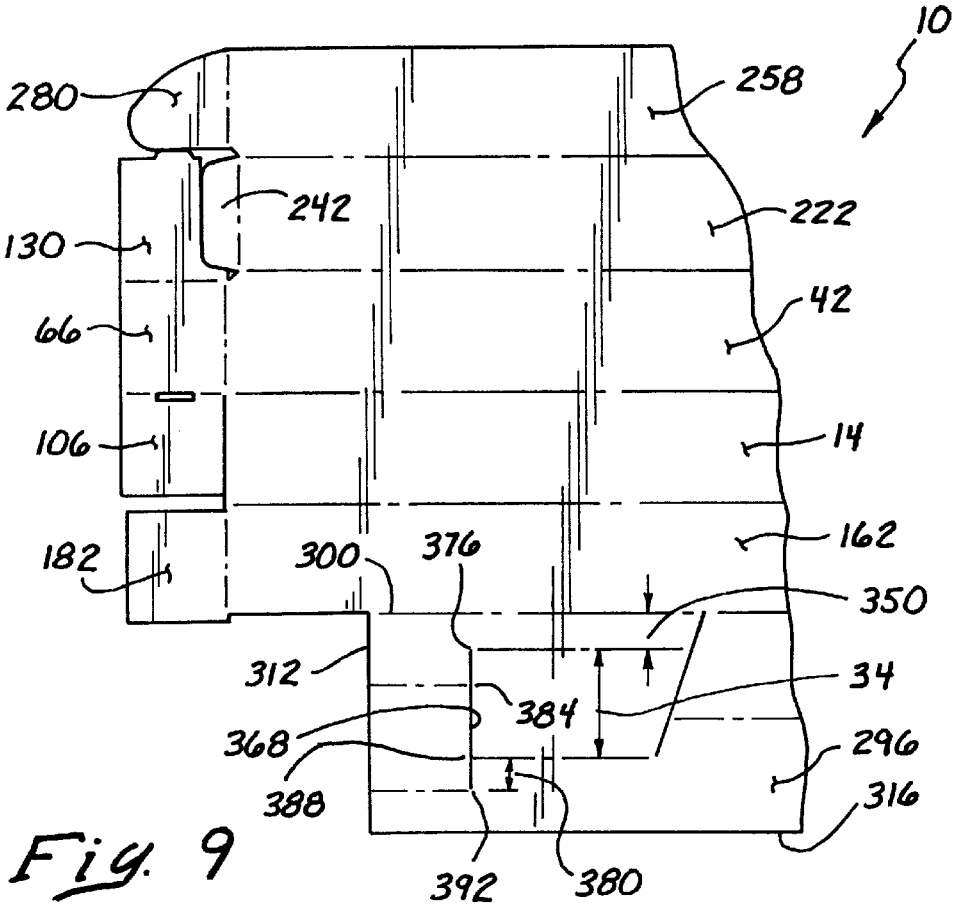
FIG. 9 is a perspective view of one end of a second embodiment of the invention providing three compartments within the container.
Figure 10:
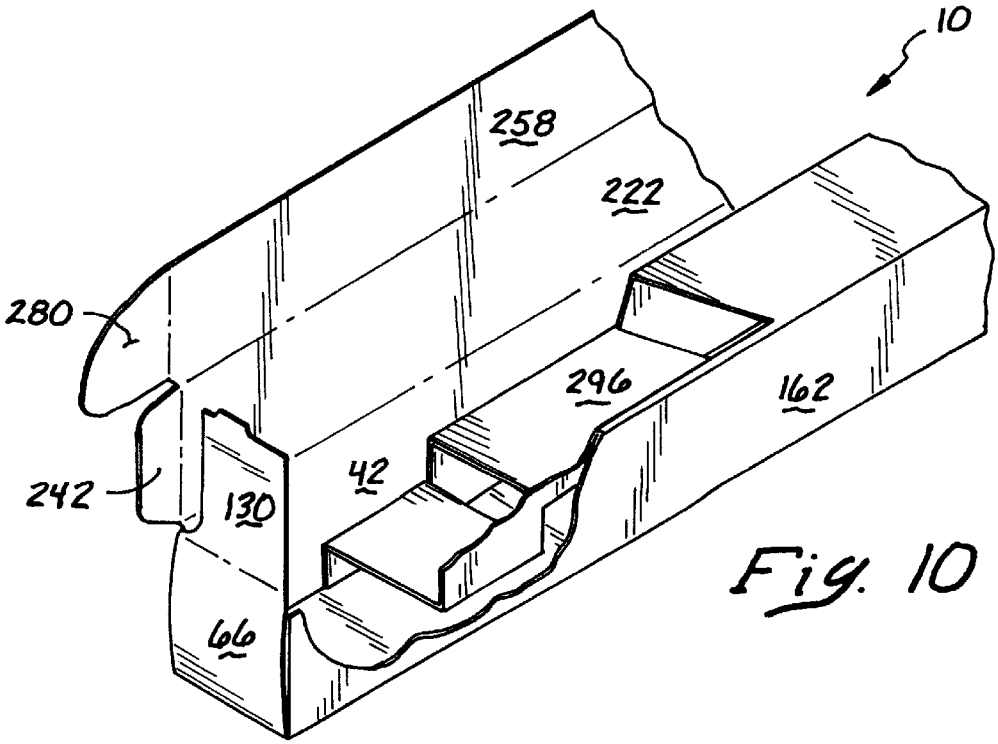
FIG. 10 is a cut-away perspective view of one end of the FIG. 9 embodiment illustrating the formation of the three compartments within the container.

As illustrated in FIGS. 9 and 10, a variation of the invention providing additional divisions of the elongated container 10 may be formed as follows. At least one additional pair of cuts 368, (not shown) located between one of the first 324 and second 328 cuts, and one of the third 312 and fourth 316 edges of the dividing partition 296. The third 368 and fourth (not shown) cuts extend from a fourth point 376 spaced from the first 300 edge of the dividing partition 296 by a third predetermined distance 380 that is less than the first predetermined distance 336, to a fifth point 384 spaced from the fourth point 376 by the third predetermined distance 380. The third 368 and fourth (not shown) cuts then extend from the fifth point 384 to a sixth point 388. The sixth point 388 is spaced from the fourth point 376 by the first predetermined width 34. The third 368 and fourth 372 cuts then extend from the sixth point 388 to a seventh point 392 spaced from the sixth point 388 by the third predetermined distance 380.

In this variation the first point 332 is spaced from the first 300 edge of the dividing partition 296 by the third predetermined distance 380 and the third point 344 is spaced from the second point 340 by the third predetermined distance 380. Also in this variation, the first perforation 348 extends from the first point 332 on the first cut 324 to the fourth point 376 on the third cut 368, the second perforation 352 extends from the third point 344 on the first cut 324 to the sixth point 388 on the third cut 368, the fourth perforation 360 extends from the first point 332 on the second cut 328 to the fourth point 376 on the fourth cut and the fifth perforation 364 extends from the third point 344 on the second cut 328 to the sixth point 388 on the fourth cut.

A sixth perforation 396 parallel to the first 300 edge of the dividing partition 296 is provided that extends from the fifth point 384 of the third cut 368 to the third edge 312 of the dividing partition 296. A seventh perforation 400 parallel to the first 300 edge of the dividing partition 296 is provided that extends from the seventh point 392 of the third cut 368 to the third 312 edge of the dividing partition 296. An eighth perforation 404 parallel to the first 300 edge of the dividing partition 296 is provided that extends from the fifth point 384 of the fourth cut to the fourth 316 edge of the dividing partition 296. A ninth perforation 408 parallel to the first 300 edge of the dividing partition 296 is provided that extends from the seventh point 392 of the fourth cut to the fourth 316 edge of the dividing partition 296.

When the dividing partition 296 is folded inwardly along the first 348 through ninth 408 perforations and folded inwardly so that its second 304 edge rests on the bottom panel 14, a container divided into at least three compartments may be formed.

Figure 2:
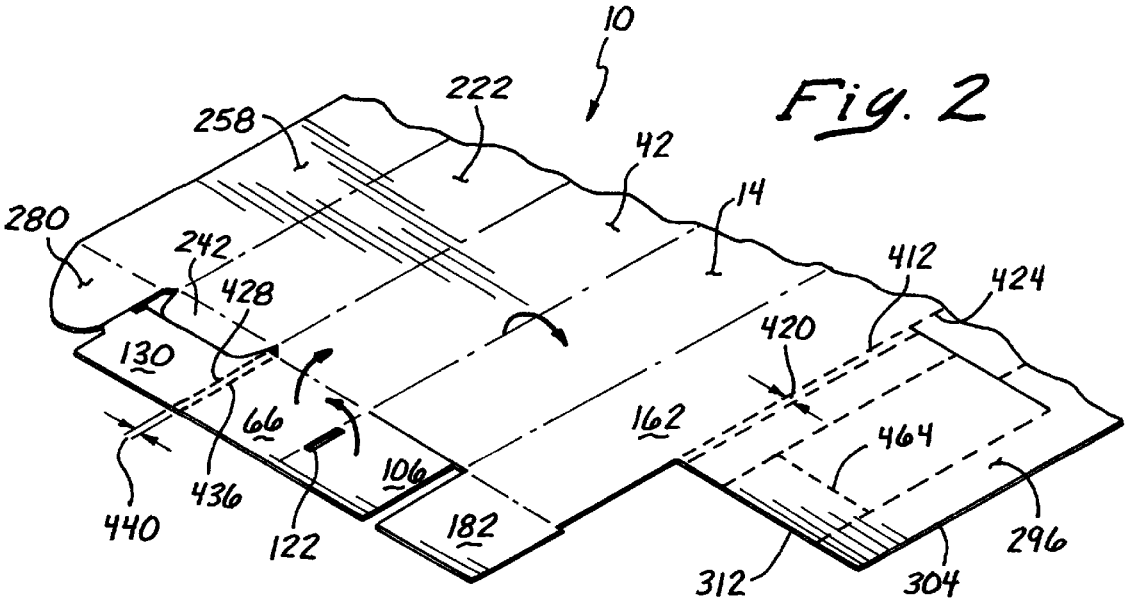
FIG. 2 is a perspective view of one end of the FIG. 1 embodiment illustrating the directions of the first three folds to assemble the container.
Figure 3:
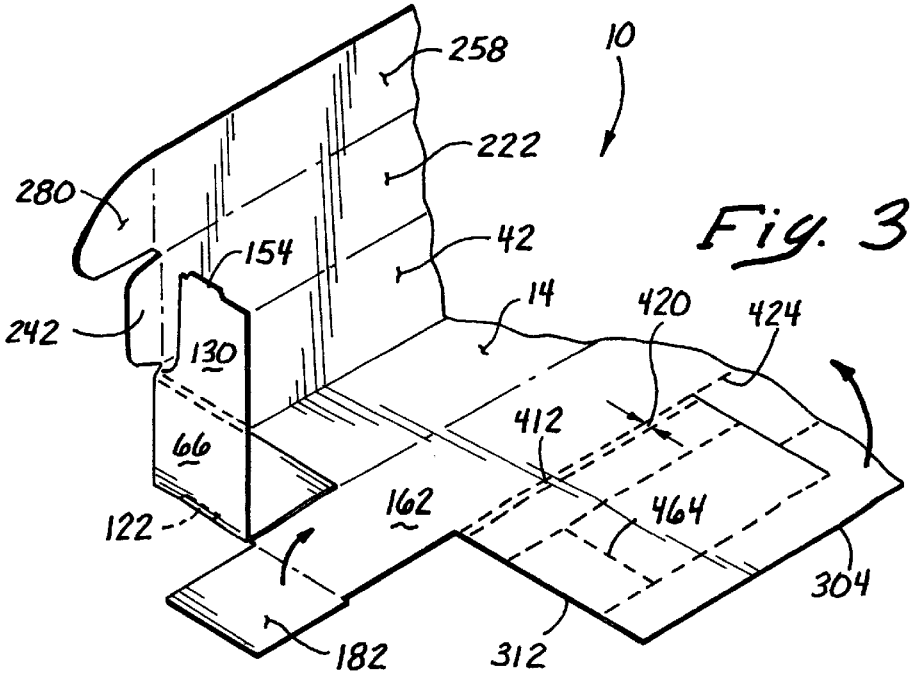
FIG. 3 is a perspective view of one end of the FIG. 1 embodiment illustrating the first side panel folded at a right angle to the bottom panel, the first first side end panel folded inwardly from the first side panel and the first tab receiving panel folded inwardly from the first first side end panel.
Figure 4:
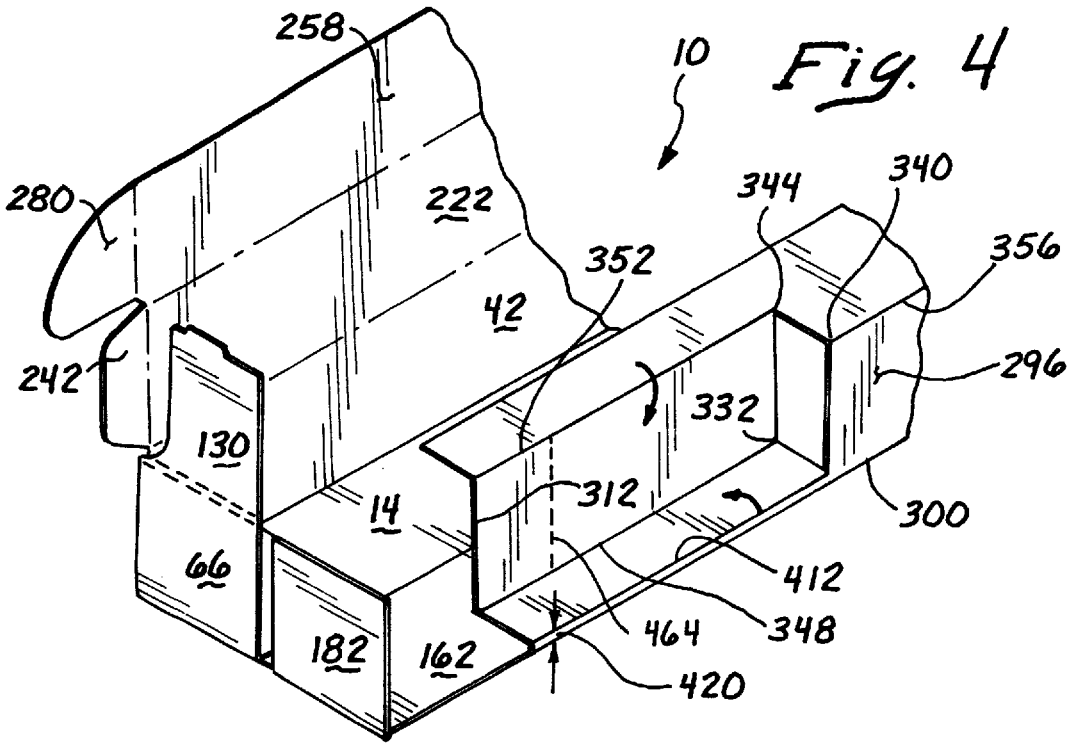
FIG. 4 is a perspective view of one end of the FIG. 1 embodiment illustrating the first second side end panel folded inwardly from the second side panel and the dividing partition folded inwardly from the second side panel.
Figure 5:
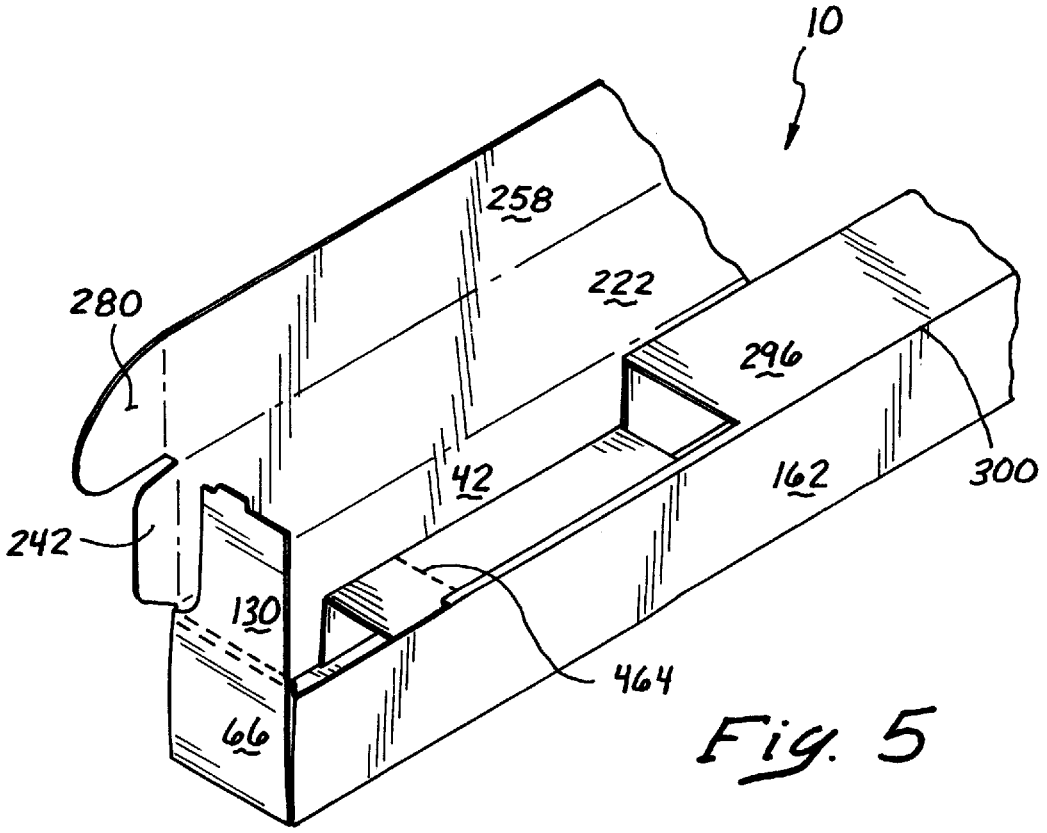
FIG. 5 is an perspective view of one end of the FIG. 1 embodiment illustrating the second side panel folded inwardly from the bottom panel and the formation of two compartments within the container.

As illustrated in FIGS. 1–3, in another variation of the invention a tenth perforation 412 parallel to the first perforation 348 and an eleventh perforation 416 parallel to the fourth perforation 360 are provided. The tenth 412 and eleventh 416 perforations are spaced a fourth predetermined distance 420 from the first edge of the dividing partition 296.

When the dividing partition 296 is folded inwardly along the first 348, second 352, third 356, fourth 360, fifth 364, tenth 412 and eleventh 416 perforations, the portions of the dividing partition 296 between the first 348 and tenth 412 perforations and between the fourth 360 and eleventh 416 perforations will abut more closely to the second side panel 162.

In yet another variation of the instant invention, the dividing partition 296 is foldably joined at its first 300 edge to the second 170 edge of the second side panel 162 at a twelfth perforation 424.

In still another variation of the invention, the first 130 locking panel is foldably joined at its proximate edge 138 to the first 74 edge of the first 66 first side end panel at a thirteenth perforation 428. Likewise, the second 134 locking panel is foldably joined at its proximate edge 142 to the first 78 edge of the second 70 first side end panel at an fourteenth perforation 432.

In yet a further variation of the instant invention a fifteenth perforation 436 parallel to the thirteenth perforation 428 is spaced a fifth predetermined distance 440 from the proximate edge 138 of the first locking panel 130. Likewise, a sixteenth perforation 444 parallel to the fourteenth perforation 432 is spaced the fifth predetermined distance 440 from the proximate edge 142 of the second locking panel 134.

When the first 130 and second 134 locking panels are folded over the first 182 and second 186 second side end panels the tab members 154, 158 may more easily engage the tab openings 122, 126 in the first 106 and second 110 tab receiving panels.

In still a further variation of the invention the distal edges 448, 452 of the first 242 and second 246 top panel end extensions are rounded for easy insertion between the first 42 and second 162 side panels.

In yet another variation of the instant invention the distal edge 456 of the first 280 front panel end extension is rounded for easy insertion between the first 66 first side end panel and the first 182 second side end panel. Likewise, the distal edge 460 of the second 284 front panel end extension is rounded for easy insertion between the second 70 first side end panel and the second 186 second side end panel.

Figure 6:
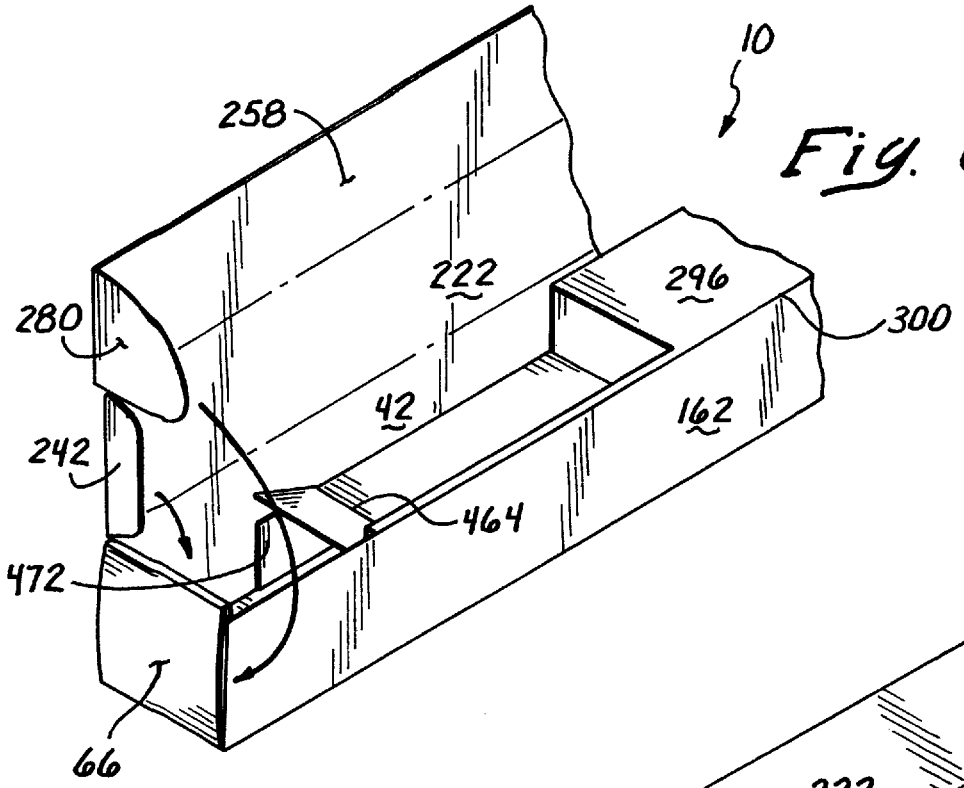
FIG. 6 is a perspective view of one end of the FIG. 1 embodiment illustrating the folding of the top panel inwardly from the first side panel and the front reinforcing panel inwardly from the top panel.
Figure 7:
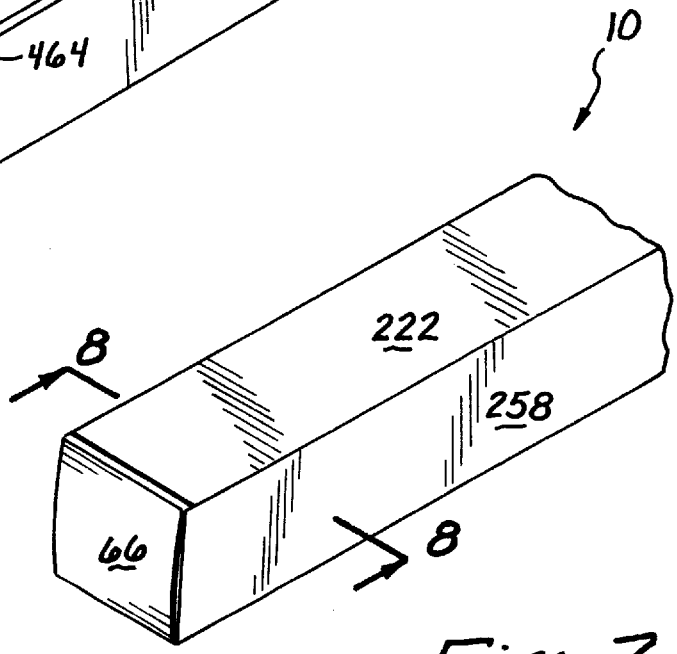
FIG. 7 is a perspective view of one end of the FIG. 1 embodiment illustrating the finished container with first top end extension bearing against the first locking panel and first front panel extension is inserted between the first first side end panel and the first second side end panel.
Figure 8:
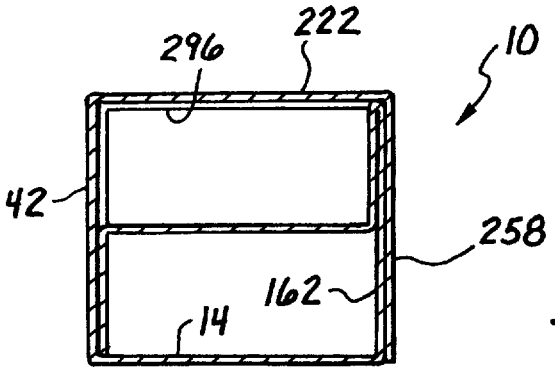
FIG. 8 is a cross-sectional end view of the container taken along the line 8—8.

In a final variation of the invention, illustrated in FIGS. 1 and 6, includes two additional perforations. A seventeenth perforation 464 extends from the first perforation 350 to the second perforation 352. The seventeenth perforation 464 is spaced from the third 312 edge of the dividing partition 296. An eighteenth perforation 468 extends from the fourth perforation 360 to the fifth perforation 364. The eighteenth perforation 468 is spaced from the fourth 316 edge of the dividing partition 296.

When a user desires to insert an item in a lower compartment 472 of the box having a height at one end greater than the second predetermined distance 348, the first 350 and second 352 perforations may be severed from the third 312 edge of the dividing partition 296 to the seventeenth perforations 464. The portion of the dividing partition 296 between the first 350 and second 352 perforations may be folded upwardly along the seventeenth perforation thereby providing additional space above the lower compartment 472 adjacent the third 312 edge of the dividing partition 296.

Likewise, the fourth 360 and fifth 364 perforations may be severed from the fourth 316 edge of the dividing partition 296 to the eighteenth perforation 468. The portion of the dividing partition 296 between the fourth 360 and fifth 364 perforations may be folded upwardly along the eighteenth perforation 468 thereby providing additional space above the lower compartment 472 adjacent the fourth 316 edge of the dividing partition 296.

The reinforced paperboard box for storage and shipping of elongated items 10 has been described with reference to particular embodiments. Other modifications and enhancements can be made without departing from the spirit and scope of the claims that follow.

I claim:

1. A reinforced paperboard box for storage and shipping of elongated items, comprising:

a bottom panel, first and second opposed side panels, a top panel and a front reinforcing panel, each of said panels being substantially rectangular in shape and having opposed longitudinal and transverse edges, said longitudinal edges being no longer than a first predetermined length, said side panels being foldably joined at their lower longitudinal edges to the bottom panel, the top panel foldably joined at its lower longitudinal edge to the upper longitudinal edge of the first side panel, the front reinforcing panel foldablyjoined at its lower longitudinal edge to the upper longitudinal edge of the top panel, to the form an elongated box, said box having a substantially rectangular cross section, a first predetermined width and a first predetermined height;

a pair of rectangular first side end panels, each of said first side end panels foldably joined to a transverse edge of the first side panel;

a pair of rectangular second side end panels, each of said second side end panels foldably joined to a transverse edge of the second side panel;

means for securing each of the first side side end panels in orthogonal alignment with each of the second side end panels when the box is assembled so as to form a pair of receiving pocket between the first side end panels and the second side end panels;

a pair of top end extensions, each of said top end extensions attached at its proximate edge to a transverse edge of the top panel;

a pair of front panel end extensions, each of said front panel end extensions attached at its proximate edge to a transverse edge of the reinforcing front panel;

a dividing partition having first and second opposed, elongated, parallel edges of a second predetermined length less than the first predetermined length, spaced apart a second predetermined width equal to the sum of the first predetermined width and the first predetermined height, and third and fourth oppossed, parallel end edges, said dividing partition foldably joined at its first edge to the lower longitudinal edge of the second side panel;

said dividing partition including at least one pair of cuts, each of said first and second cuts spaced from one of the third and fourth edges of the dividing partition;

each of said first and second cuts extending from the first edge of the dividing partition to a first point spaced from the first edge by a first predetermined distance, from said first point to a second point spaced from the first edge by the first predetermined width, and from said second point to a third point, said third point spaced from the second edge of the dividing partition by a second predetermined distance;

a first perforation parallel to the first edge of the dividing partition, said first perforation extending from the first point of the first cut to the third edge of the dividing partition;

a second perforation parallel to the first edge of the dividing partition, said second perforation extending from the third point of the first cut to the third edge of the dividing partition;

a third perforation parallel to the first edge of the dividing partition, said third perforation extending from the second point of the first cut to the second point of the second cut;

a fourth perforation parallel to the first edge of the dividing partition, said fourth perforation extending from the first point of the second cut to the fourth edge of the dividing partition;

a fifth perforation parallel to the first edge of the dividing partition, said fifth perforation extending from the third point of the second cut to the fourth edge of the dividing partition;

whereby, when the first and second side panels are folded inwardly from the bottom panel, and the first side end panels and the second side end panels are secured in orthogonal alignment, an open topped rectangular container with closed ends may be formed; and whereby, when the dividing partition is folded inwardly along the first, second, third, fourth and fifth perforations and inwardly from the second side panel so that its second edge rests upon the bottom panel, and the top end extensions are inserted between the first and second side panels, and the reinforcing front panel is folded inwardly from the top panel and over the second side panel, and the front panel end extensions are inserted into the receiving pockets formed between the first and second side end panels, a closed reinforced paperboard box divided into a plurality of compartments for storage and shipping of elongated items may be formed.

2. A one-piece, planar, paperboard blank for forming the reinforced paperboard box of claim 1.

3. A reinforced paperboard box for storage and shipping of elongated items, comprising:

a rectangular bottom panel having first and second opposed, elongated, parallel, side edges, third and fourth opposed, parallel end edges normal to the first and second edges, a first predetermined width measured between the first and second edges and a first predetermined length measured between the third and fourth edges;

a first side panel having first and second opposed, elongated, parallel edges of the first predetermined length, third and fourth opposed, parallel end edges, a first predetermined height measured between the first and second edges, said first side panel foldably joined at its second edge to the first edge of the bottom panel;

first and second abutting rectangular first side end panels, each of said first side end panels having first and second opposed, parallel edges of the first predetermined width and third and fourth opposed, parallel edges of the first predetermined height, said first first side end panel foldably joined at its fourth edge to the third edge of the first side panel and said second first side end panel foldably joined at its third edge to the fourth edge of the first side panel;

first and second tab receiving panels, each of said tab receiving panels having a proximate edge not greater in length than the first predetermined width and being foldably joined at said proximate edge to the second edge of one of the first and second first side end panels;

each of said first and second tab receiving panels including a tab opening disposed along its proximate edge;

first and second locking panels, each of said locking panels having a proximate edge not greater in length than the first predetermined width, an opposed parallel, distal edge and being foldably joined at said proximate edge to the first edge of one of the first and second first side end panels;

each of said first and second locking panels including a tab member extending outwardly from its distal edge, said tab member sized, shaped and disposed to engage the tab opening in one of the first and second tab receiving panels;

a second side panel having first and second opposed, elongated, parallel edges of the first predetermined length, third and fourth opposed, parallel end edges, of the first predetermined height measured between the first and second edges, said second panel foldably joined at its first edge to the second edge of the bottom panel;

first and second abutting rectangular second side end panels, each of said second side end panels having first and second opposed, parallel edges of the first predetermined width and third and fourth opposed, parallel edges of the first predetermined height, said first second side end panel foldably joined at its fourth edge to the third edge of the second side panel and said second second side end panel foldably joined at its third edge to the fourth edge of the second side panel;

a top panel having first and second opposed, elongated, parallel edges of less than the first predetermined length, third and fourth opposed, parallel end edges spaced apart by the first predetermined width, said top panel foldably joined at its second edge to the first edge of the first side panel;

first and second top end extensions, each of said top end extensions having a proximate edge not greater in length than the first predetermined width and being foldably joined at said proximate edge to one of the third and fourth edges of the second side panel;

a front reinforcing panel having first and second opposed, elongated, parallel edges of the first predetermined length, third and fourth opposed, parallel end edges spaced apart by no more than the first predetermined height, said front reinforcing panel foldably joined at its second edge to the first edge of the top panel;

first and second front panel end extensions, each of said end extensions having a proximate edge not greater in length than the first predetermined height and being foldably joined at said proximate edge to one of the third and fourth edges of the front reinforcing panel;

a dividing partition having first and second opposed, elongated, parallel edges of a second predetermined length less than the first predetermined length spaced apart a second predetermined width equal to the sum of the first predetermined width and the first predetermined height, and third and fourth opposed, parallel end edges, said dividing partition foldably joined at its first edge to the second edge of the second side panel;

said dividing partition including at least one pair of cuts, each of said first and second cuts spaced from one of the third and fourth edges of the dividing partition;

each of said first and second cuts extending from the first edge of the dividing partition to a first point spaced from the first edge by a first predetermined distance, from said first point to a second point spaced from the first edge by the first predetermined width, and from said second point to a third point, said third point spaced from the second edge of the dividing partition by a second predetermined distance;

a first perforation parallel to the first edge of the dividing partition, said first perforation extending from the first point of the first cut to the third edge of the dividing partition;

a second perforation parallel to the first edge of the dividing partition, said second perforation extending from the third point of the first cut to the third edge of the dividing partition;

a third perforation parallel to the first edge of the dividing partition, said third perforation extending from the second point of the first cut to the second point of the second cut;

a fourth perforation parallel to the first edge of the dividing partition, said fourth perforation extending from the first point of the second cut to the fourth edge of the dividing partition;

a fifth perforation parallel to the first edge of the dividing partition, said fifth perforation extending from the third point of the second cut to the fourth edge of the dividing partition;

whereby, when the first and second tab receiving panels are folded inwardly from the first and second first side end panels, and the first and second first side end panels are folded inwardly from the first side panel, and the first side panel is folded inwardly from the bottom panel, and the first and second second side end panels are folded inwardly from the second side panel, and the second side panel is folded inwardly from the bottom panel, and the first and second locking panels are folded over the first and second second side end panels so that the tab members of said second side end panels engage the tab openings of the first and second tab receiving panels, and the dividing partition is folded inwardly along the first, second, third, fourth and fifth perforations and inwardly from the second side panel so that its second edge rests upon the bottom panel, an open topped container divided into a plurality of compartments may be formed; and whereby, when the first and second top end extensions are folded inwardly from the top panel and the top panel is folded inwardly from the first side panel so that the first and second top end extensions bear against the first and second locking panels, and the first and second front panel extensions are folded inwardly from the front reinforcing panel, and the front reinforcing panel is folded inwardly from the top panel and over the second side panel, and the first front panel extension is inserted between the first first side end panels and the first second side end panel, and the second front panel extension is inserted between the second first side end panels and the second second side end panel a closed reinforced paperboard box for storage and shipping of elongated items may be formed.

4. A reinforced paperboard box for storage and shipping of elongated items as described in claim 3, said dividing partition further comprises:

at least one additional pair of cuts, each of said third and fourth cuts disposed between one of the first and second cuts, and one of the third and fourth edges of the dividing partition and extending from a fourth point spaced from the first edge of the dividing partition by the third predetermined distance, to a fifth point spaced from the fourth point by the third predetermined distance, to a sixth point spaced from the fourth point by the first predetermined width, to a seventh point spaced from the sixth point by the third predetermined distance;

said first point is spaced from the first edge of the dividing partition by a third predetermined distance, less than the first predetermined distance;

said third point is spaced from the second point by the third predetermined distance;

said first perforation extends from the first point on the first cut to the fourth point on the third cut;

said second perforation extends from the third point on the first cut to the sixth point on the third cut;

said fourth perforation extends from the first point on the second cut to the fourth point on the fourth cut;

said fifth perforation extends from the third point on the second cut to the sixth point on the fourth cut;

a sixth perforation parallel to the first edge of the dividing partition, said sixth perforation extending from the fifth point of the third cut to the third edge of the dividing partition;

a seventh perforation parallel to the first edge of the dividing partition, said seventh perforation extending from the seventh point of the third cut to the third edge of the dividing partition;

a eighth perforation parallel to the first edge of the dividing partition, said eighth perforation extending from the fifth point of the third cut to the fourth edge of the dividing partition;

a ninth perforation parallel to the first edge of the dividing partition, said ninth perforation extending from the seventh point of the fourth cut to the fourth edge of the dividing partition; and whereby when the dividing partition is folded inwardly along the first through ninth perforations and folded inwardly so that its second edge rests on the bottom a container divided into at least three compartments may be formed.

5. A one-piece, planar, paperboard blank for forming the reinforced paperboard box of claim 4.

6. A reinforced paperboard box for storage and shipping of elongated items as described in claim 3, further comprising:

a tenth perforation parallel to the first perforation spaced a fourth predetermined distance from the first edge of the dividing partition;

an eleventh perforation parallel to the fourth perforation spaced the fourth predetermined distance from the first edge of the dividing partition; and whereby, when the dividing partition is folded inwardly along the first, second, third, fourth, fifth, tenth and eleventh perforations, the portions of the dividing partition between the first and tenth perforations and between the fourth and eleventh perforations will abut more closely to the second side panel.

7. A one-piece, planar, paperboard blank for forming the reinforced paperboard box of claim 6.

8. A reinforced paperboard box for storage and shipping of elongated items as described in claim 3 wherein the dividing partition is foldably joined at its first edge to the second edge of the second side panel at a twelfth perforation.

9. A one-piece, planar, paperboard blank for forming the reinforced paperboard box of claim 8.

10. A reinforced paperboard box for storage and shipping of elongated items as described in claim 3, wherein:

the first locking panel is foldably joined at its proximate edge to the first edge of the first first side end panel at a thirteenth perforation;

the second locking panel is foldably joined at its proximate edge to the first edge of the second first side end panel at an fourteenth perforation.

11. A one-piece, planar, paperboard blank for forming the reinforced paperboard box of claim 10.

12. A reinforced paperboard box for storage and shipping of elongated items as described in claim 10, further comprising:

a fifteenth perforation parallel to the thirteenth perforation spaced a fifth predetermined distance from the proximate edge of the first locking panel;

an sixteenth perforation parallel to the fourteenth perforation spaced the fifth predetermined distance from the proximate edge of the second locking panel; and whereby, when the first and second locking panels are folded over the first and second second side end panels the tab members may more easily engage the tab openings in the first and second tab receiving panels.

13. A one-piece, planar, paperboard blank for forming the reinforced paperboard box of claim 12.

14. A reinforced paperboard box for storage and shipping of elongated items as described in claim 3 wherein the distal edges of the first and second top panel end extensions are rounded for easy insertion between the first and second side panels.

15. A one-piece, planar, paperboard blank for forming the reinforced paperboard box of claim 14.

16. A reinforced paperboard box for storage and shipping of elongated items as described in claim 3, wherein:

the distal edge of the first front panel end extension is rounded for easy insertion between the first first side end panel and the first second side end panel; and the distal edge of the second front panel end extension is rounded for easy insertion between the second first side end panel and the second second side end panel.

17. A one-piece, planar, paperboard blank for forming the reinforced paperboard box of claim 16.

18. A reinforced paperboard box for storage and shipping of elongated items as described in claim 3, further comprising:

a seventeenth perforation, extending from the first perforation to the second perforation, said seventeenth perforation spaced from the third edge of the dividing partition;

an eighteenth perforation, extending from the fourth perforation to the fifth perforation, said eighteenth perforation spaced from the fourth edge of the dividing partition; and whereby, when a user desires to insert an item in a lower compartment of the box having a height at one end greater than the second predetermined distance, the first and second perforations may be severed from the third edge of the dividing partition to the seventeenth partition and the portion of the dividing partition between the first and second partitions may be folded upwardly along the seventeenth partition thereby providing additional space above the lower compartment adjacent the third edge of the dividing partition and the fourth and fifth perforations may be severed from the fourth edge of the dividing partition to the eighteenth partition and the portion of the dividing partition between the fourth and fifth partitions may be folded upwardly along the eighteenth partition thereby providing additional space above the lower compartment adjacent the fourth edge of the dividing partition.

19. A one-piece, planar, paperboard blank for forming the reinforced paperboard box of claim 18.

20. A one-piece, planar, paperboard blank for forming the reinforced paperboard box of claim 3.

* * * * *